United States Patent [19]

Yamamoto et al.

[11] Patent Number: 4,860,053

[45] Date of Patent: Aug. 22, 1989

[54] COLOR IMAGE FORMING APPARATUS HAVING A PLURALITY OF DEVELOPING UNITS

[75] Inventors: Haruo Yamamoto, Sennan; Takao Ichihashi, Sakai; Shuji Fujisawa, Ibaragi; Eiichi Tone; Takeshi Tsuda, both of Sakai, all of Japan

[73] Assignee: Mita Industrial Co., Ltd., Osaka, Japan

[21] Appl. No.: 112,268

[22] Filed: Oct. 20, 1987

[30] Foreign Application Priority Data

| | | | |
|---|---|---|---|
| Oct. 23, 1986 | [JP] | Japan | 61-253084 |
| Jan. 28, 1987 | [JP] | Japan | 62-19493 |
| Jan. 28, 1987 | [JP] | Japan | 62-19494 |

[51] Int. Cl.[4] ..... G03G 15/06

[52] U.S. Cl. ..... 355/245; 355/251; 355/326; 118/645

[58] Field of Search ..... 355/14 D, 4, 3 DD, 14 R; 118/645, 656, 657, 658

[56] References Cited

U.S. PATENT DOCUMENTS

| | | | |
|---|---|---|---|
| 3,970,042 | 7/1976 | Rees | 355/4 X |
| 4,465,363 | 8/1984 | Schmitt | 355/15 |
| 4,481,275 | 11/1984 | Iseki et al. | 355/15 X |
| 4,652,113 | 3/1987 | Watanabe | 355/4 X |
| 4,710,016 | 12/1987 | Waatanabe | 355/4 |

OTHER PUBLICATIONS

European Patent Application 0-193-274, Published 9/3/86, Hisashi et al.

*Primary Examiner*—R. L. Moses

*Attorney, Agent, or Firm*—Koda and Androlia

[57] ABSTRACT

A multicolor image forming apparatus having a plurality of developing units respectively containing different color developers; comprising a newly selected developing unit switching timing controller for controlling the rotation of the photoreceptor and the timing for switching of the newly selected developing unit, or a previously selected developing unit switching timing controller for controlling the rotation of the photoreceptor and the switching timing of the previously selected developing unit.

9 Claims, 12 Drawing Sheets

COLOR IMAGE FORMING APPARATUS HAVING A PLURALITY OF DEVELOPING UNITS

BACKGROUND OF THE INVENTION

1. Field of the Invention

The present invention relates to color mixing prevention in multicolor image forming apparatus such as electronic photocopiers, facsimiles, etc., which have a plurality of developing units containing different color developers.

2. Description of the Prior Art

A multicolor image forming apparatus having a plurality of developing units containing different color developers has a mechanism for making alternative selection of one of these developing units, such that the trouble of mixing different color developers by simultaneous selection of two or more developing units may be foreclosed.

Thus each of a plurality of developing units containing different color developers is subjected to switching control between the state adapted for making development (which is referred to as developing state) and the state not adapted for making development (which is referred to as non-developing state) by moving each developing unit adjacent to or away from a photoreceptor, but respective developing units are interlocked so that as one developing unit is selected and moved adjacent to the photoreceptor for the purpose of changing the color of the image, then, the other is invariably distanced therefrom.

A conventional example of such multicolor forming apparatus is disclosed in U.S. Pat. No. 3,970,042, for example.

However, such conventional multicolor image forming apparatus have a problem in that while the mixing of different color developers is prevented by making alternative selection between a plurality of developing units, it is impossible to prevent a small amount of residual developer remaining on the photoreceptor from mixing with the other color developer even if cleaning after each copying has been done.

Thus normally, in a copier, etc., a cleaning unit equipped with a cleaning blade for removing the developer remaining on the photoreceptor after transfer process is arranged on the perimeter of the photoreceptor, besides the developing units for developing the latent image on the photoreceptor, so that when the copier is in its image forming state, the cleaning blade comes in contact with the photoreceptor, to scrape off the aforementioned residual developer, thus foreclosing its conveyance downstream side of the blade. Since this cleaning blade is designed to be spaced apart from the photoreceptor when it is not in its image forming state to prevent injuring the photoreceptor, due to the operation of contacting and separating (ON and OFF) of the cleaning blade, the developer sticking on this blade or one accumulated on the spot around the position where this blade has been contact with the photoreceptor sometimes deposits on the area on the photoreceptor downstream of the blade. Or the photoreceptor is sometimes shifted, while this blade is drawn apart from its surface, so that the developer accumulated near the spot where the blade has been in contact therewith is brought to the downstream side of the blade. And heretofore, when this device is brought into its image forming state, while this blade is brought in contact with the photoreceptor and the photoreceptor is rotationally driven, the developing unit which is to be brought into its developing state has instantly been moved adjacent to the photoreceptor. Then the developer adhering on an area on the photoreceptor downstream of the aforementioned cleaning blade (this is called residual developer stripe, because striped configuration is formed by the blade), without being removed by this blade, is conveyed by the rotation of the photoreceptor, as carried thereon; as a result, it comes to mix into the magnetic brush of the developer produced by the developing unit which has already moved adjacent photoreceptor, giving rise to occurrence of unexpected color mixing.

In an apparatus in which the rotation of the photoreceptor is started before the cleaning blade is brought in contact with the photoreceptor for prevention of catching of the cleaning blade therewith at the time of starting the rotation of the photoreceptor, the developer which has stuck in a stripe configuration along the part where the tip of the cleaning blade was placed, when the cleaning blade has been, separated from the photoreceptor upon ending the image forming state (i.e., residual developer stripe), will pass beneath the cleaning blade as it is and be carried to the position of the developing unit which has already been approached to the photoreceptor, resulting in color mixing.

SUMMARY OF THE INVENTION

The object of this invention is to provide an image forming apparatus in which the developer adhering on the photoreceptor is prevented from mixing with different color developer.

The present invention provides a multicolor image forming apparatus having a plurality of developing units respectively containing different color developers and being capable of designating the color of the image by bringing about the developing state of one of them by alternatively selecting it and moving it adjacent to a photoreceptor and also by bringing about the non-developing state of the other by separating it from the photoreceptor, the aforementioned apparatus comprising a newly selected developing unit switching timing control means for controlling the rotation of the photoreceptor and the timing for switching of the newly selected developing unit in such a way that after residual developer stripe has passed through the developing region of the newly selected developing unit, the newly selected developing unit moves toward the photoreceptor, thereby to be in its developing state, or a previously selected developing unit switching timing control means for controlling the rotation of the photoreceptor and the switching timing of the previously selected developing unit in such a way that the previously selected developing unit moves away from the photoreceptor, after residual developer stripe has passed through the developing region of the previously selected developing unit, when the previously selected developing unit is placed on the upstream side, as defined by the rotation of the photoreceptor, of the newly selected developing unit.

Thus the gist of this invention lies in controlling the rotation of the photoreceptor and the switching between developing units with a timing which will satisfy the following condition 1 or 2:

Condition 1 a. The newly selected developing unit moved adjacent the photoreceptor, to be in its developing state, after residual developer stripe has passed the developing region of the newly selected developer.

b. The timing for setting the previously selected developing unit separated from the photoreceptor is arbitrary in principle. But it is preferable that the separation be done before the residual developer stripe has passed through its developing region.

Condition 2

This condition is applicable only to the arrangement in which the previously selected developing unit is placed on the upstream side of the newly selected developing unit, as defined by the rotation of the photoreceptor:

a. The previously selected developing unit shall be separated from the photoreceptor, after the residual developer stripe has passed the developing region of the previously selected developing unit.

b. The timing with which the newly selected developing unit is moved adjacent to the photoreceptor, to be in its developing state, is arbitrary in principle. But it is preferable that the movement occur, after the residual developer stripe has passed through its developing region.

With regard to the aforementioned conditions 1 and 2, sometimes only either one of these conditions will be satisfied, but sometimes, both, in view of the fact that the rate of revolution of the photoreceptor and the switching speed of the developing unit are different from one type of image forming apparatus to another and the fact that some developing unit has a mechanism with which it is always alternatively selected, but some does not. Furthermore, for example, the color mixing of black residual developer stripe with a red developing unit shall invariably be avoided, but the reverse mixing sometimes is prohibited, but sometimes admitted. Accordingly, in some cases, only either one of these conditions shall be met, but in other cases, both, as specified by the designer's selection.

DETAILED DESCRIPTION OF THE PREFERRED EMBODIMENTS

In the following, the present invention will be described further in detail in connection with embodiments shown in the accompanying drawings, but this invention will not be limited thereby.

Figure 1:
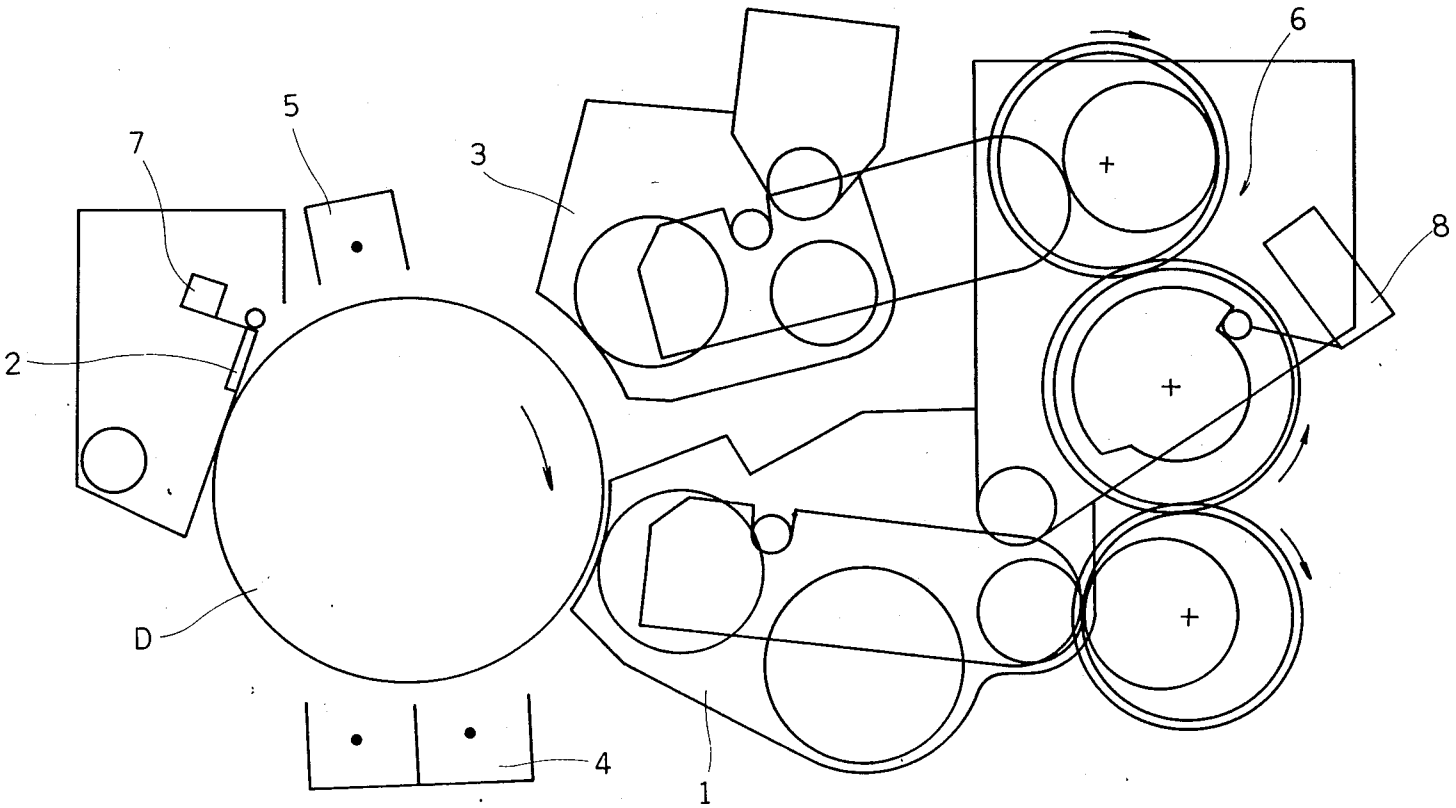
FIG. 1 is a schematic diagram of the main part of a copier, an embodiment of this invention.

Referring to FIG. 1, there are arranged around a photoreceptor drum D, a main developing unit 1 containing a black toner, transferring unit 4, cleaning blade 2, charging unit 5 and sub-developing unit 3 containing a red toner.

Either one of the main developing unit 1 and the sub-developing unit 3 is alternatively selected by an alternatively selecting mechanism 6 and the magnetic brush formed by the toner of the selected developing unit is brought into rubbing contact with the photoreceptor drum D. Which developing unit has been selected is detectable by means of a detector switch 8.

The cleaning blade 2 is brought down to and separated away from the surface of the photoreceptor drum D by means of a blade solenoid 7.

Figure 2:
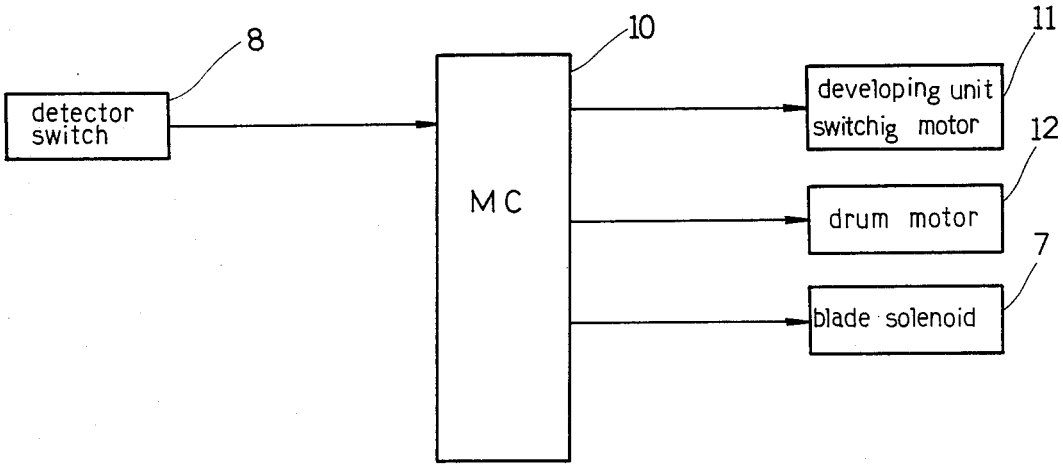
FIG. 2 is a block diagram of developing unit switching control system of the copier shown in FIG. 1.
Figure 3A:
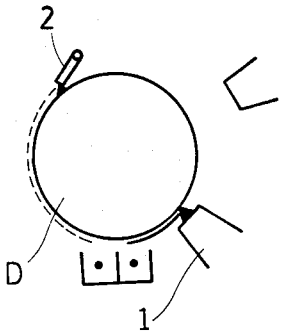
FIG. 3 (*a*)–(*e*) are schematic sectional views for explanation of an example of the operation of the preprocessing control of the copier shown in FIG. 1.
Figure 3B:
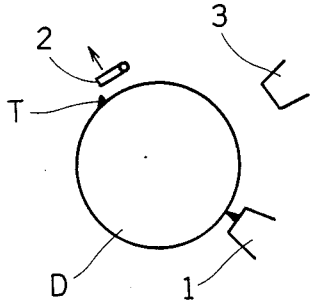
Figure 3C:
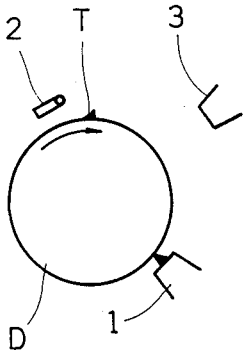
Figure 3D:
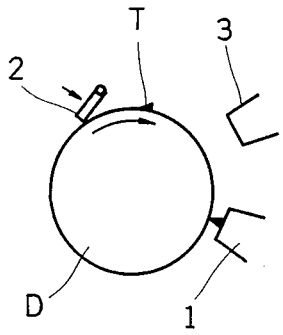
Figure 3E:
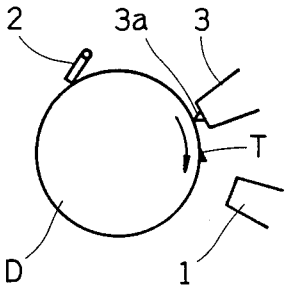
Figure 4A:
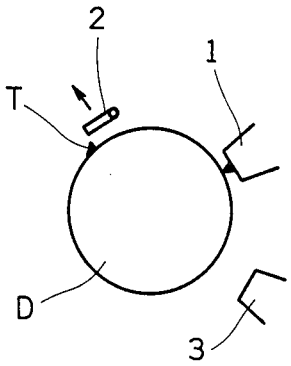
FIGS. 4 (*a*)–(*d*) are equivalent views to FIGS. 3's showing another example of the operation of the preprocessing control.
Figure 4B:
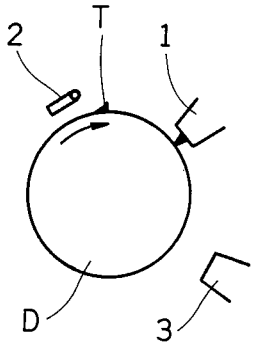
Figure 4C:
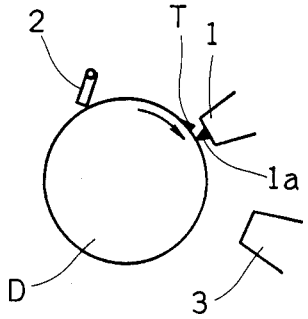
Figure 4D:
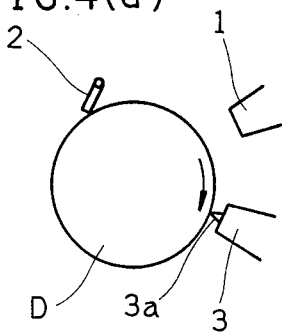
Figure 5:
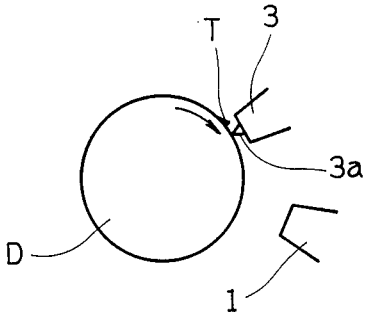
FIG. 5 is a schematic sectional view for explanation of the mixing in conventional copiers.

FIG. 2 shows a developing unit switching control system of a copier, in which by a microcomputer 10, a detector switch 8 is read, whereby a developing unit switching motor 11, drum motor 12 and a blade solenoid 7 are controlled. The microcomputer 10 besides controls the operation of the transferring unit 4 and the charging unit 5, etc., as a control center.

The developing unit switching motor 11 alternatively select either the main developing unit 1 or the sub-developing unit 3 by driving the alternatively selecting mechanism 6.

The drum motor 12 causes the photoreceptor drum D to turn.

Now, FIGS. 3(*a*)–(*e*) represent the operation run when the switching is made from the main developing unit 1 to the sub-developing unit 3 in this copier.

First, as shown in FIG. 3(*a*), when copying is being done with a main developing unit 1 containing black toner selected, the black toner left untransferred on the photoreceptor drum D is being removed by means of the cleaning blade 2, but as the cleaning blade 2 has been separated from the photoreceptor drum D after copying as shown in FIG. 3(*b*), the black toner will be left in a stripe configuration along the part where the tip of the cleaning blade 2 is located, forming a residual toner stripe T. The photoreceptor drum D is in standstill.

Then when the copying is to run with the sub-developing unit 3 containing a red toner selected, in order to prevent catching of the cleaning blade 2, the turning of the photoreceptor drum D is started before bringing the cleaning blade 2 down on to the photoreceptor drum D.

In a conventional apparatus, the main developing unit 1 immediately will move out of contact with the photoreceptor drum D, while moving the sub-developing unit 3 toward the photoreceptor drum D. As a consequence, the black residual toner stripe T will come in contact with the magnetic brush 3*a* of the red toner extending to the photoreceptor drum D from the sub-developing unit 3, to be absorbed thereby, causing the black toner to be mixed with the red toner. This raises a problem of producing soil on the red copy.

In contrast, in the apparatus of this invention, as an instruction is given for making copying with the sub-developing unit 3 selected, the microcomputer 10 detects by means of a detector switch 8 the fact that the main developing unit 1 was selected in the previous copying.

Then first, the photoreceptor drum D is started to turn in the state of the main developing unit 1 being as selected, as shown in FIG. 3(*c*) and, thereafter, the cleaning blade 2 is brought down, as shown in FIG. 3(*d*).

As the photoreceptor drum D rotates, the residual toner stripe T will move toward the developing unit side.

And, as shown in FIG. 3(*e*), after the photoreceptor drum D is turned for the amount or the angle required to let the residual toner stripe T to pass beneath the sub-developing unit 3, the switching operation is made from the main developing unit 1 to the sub-developing unit 3 by driving the developing unit switching motor 11.

As the sub-developing unit 3 has been selected with the aforementioned processing timing, the normal copying process may be run.

As understood from FIG. 3(*e*), the magnetic brush 3*a* of the red toner of the sub-developing unit 3 makes rubbing contact with he photoreceptor drum D after the black residual toner stripe T has passed thereunder, as seen from the unit side, wherefore their mixing is prevented. And as the photoreceptor drum D has made further rotation, the residual toner stripe T is removed by the cleaning blade 2, so that its mixing possibility will be eliminated.

It will be further understood that the mixing which will occur when the copying is performed with the sub-developing unit 3 selected, after a copying has done with the main developing unit 1 selected (that is, the mixing made when the black residual toner stripe is absorbed by the magnetic blush of red toner) particularly raises a problem; therefore, in this instance, it is invariably necessary to make the aforementioned preprocessing. But otherwise, this process is arbitrary.

For example, when copying is done with the main developing unit 1 selected, after performing a copying with the sub-developing unit 3 selected, it is of course proper to select the sub-developing unit 3, turn the photoreceptor drum D for the specified amount or angle, as the similar pretreatment as hereabove-mentioned, and then select the main developing unit 1. But it may be permissible to make the switching to the main developing unit 1 simultaneously as the copying instruction has been given. This is because while the absorption and mixing of the black residual toner stripe T by and with the magnetic brush 3*a* of red toner should always be prevented, but in the reverse case, although this prevention is desirable, no distinctive soiling will be brought about on the black copy and, therefore, no substantial disservice will result from omission of this preventive processing.

Even when the same developing unit as the previous one is to be selected, it is proper for coordinated simplification of control, to perform the 2 processes prior to the process of switching between developing units, or the process of selecting the main developing unit 1 and the process of turning the photoreceptor the specified amount or angle. Accordingly, it is proper always to run the process of selecting the main developing unit 1 and the process of turning the photoreceptor drum D the specified amount or angle between just after carrying out a copying and just before making the next copying. In this instance, it is acceptable to always select the main developing unit 1 at the start of copying or always to keep the state of the main developing unit 1 being selected at the end of the copying operation.

While in the above-described embodiment, description is made with a copier having the sub-developing unit 3 placed on the upstream side, as defined by the rotation of the photoreceptor drum D, and the main developing unit 1 on the downstream side, as an example, FIG. 4 provides an operational explanation with a copier having its main developing unit 1 on the upstream side and the sub-developing unit 3 on the downstream side.

First, as shown in FIG. 4(*a*), in the state of a copying with the main developing unit 1 selected having been accomplished, a residual toner stripe T is formed on a part of the photoreceptor drum D surface with which the cleaning blade 2 has moved out of contact.

As an instruction has been given for making a copying with the sub-developing unit 3 selected, first, the photoreceptive drum D is rotated in the state of the main developing unit 1 being selected; then, the residual toner stripe T will pass beneath the cleaning blade 2 as shown in FIG. 4(*b*).

When the cleaning blade 2 is brought down, while the photoreceptor drum D is turning and, then, the photoreceptor drum D is further rotated, the residual toner stripe T will come in contact with the magnetic brush 1*a* of the main developing unit 1 as shown in FIG. 4(*c*). Then the black residual toner stripe T will be absorbed by and mix with the magnetic brush 1*a* of black toner, to disappear.

Then, as shown in FIG. 4(*d*), as the switching is made to the sub-developing unit 3, after the photoreceptor drum D has been turned until the residual toner stripe T is in contact with the magnetic brush 1*a*, no mixing of the residual toner stripe T will occur with the magnetic brush 3*a* of the sub-developing unit 3, because the stripe has disappeared.

In this way, although differing in principle from that in the case of FIG. 3, color mixing caused by residual toner stripe T is prevented by a similar timing control.

In the case represented by FIG. 4, when copying is done with the sub-developing unit 3 selected after making a copying with the main developing unit 1 selected, the preprocessing are invariably necessary, but in other cases, they are arbitrary. Accordingly, the description given hereabove is similarly applicable.

Thus according to this invention, there is provided a copier having a main developing unit containing a first color toner and a sub-developing unit containing a second color toner and which permits copying with the first or the second color to be done by alternatively selecting either one of them and approaching it to a photoreceptor drum, said copier comprising a sequence control means by which after making a copying with a first color but before making a copying with a second color, the main developing unit is selected and approached to the photoreceptor drum, the photoreceptor drum is, then, turned a specified amount on angle and, thereafter, the subdeveloping unit is selected and approached to the photoreceptor drum; whereby, mixing of the first color toner remaining on the photoreceptor drum surface with the second color toner of the subdeveloping unit is prevented, thus enabling the copying quality to be improved.

And the specified amount or angle is, in case of above embodiments, the amount of rotation from a position on the photoreceptor drum directly facing the cleaning blade to a position directly facing the developing unit located on the upstream side thereof, as defined by the rotation of the photoreceptor drum. In another case, it may be the amount of rotation from a position on the photoreceptor drum directly facing the cleaning blade to a position directly facing the developing unit placed downstream side thereof, as defined by the rotation of the photoreceptor drum.

Then as an another embodiment, explanation is taken of application of this invention to a copier in which at the outset of copying, first, the cleaning blade is brought in contact with the photoreceptor drum and, then, the photoreceptor drum is set in motion.

Figure 6:
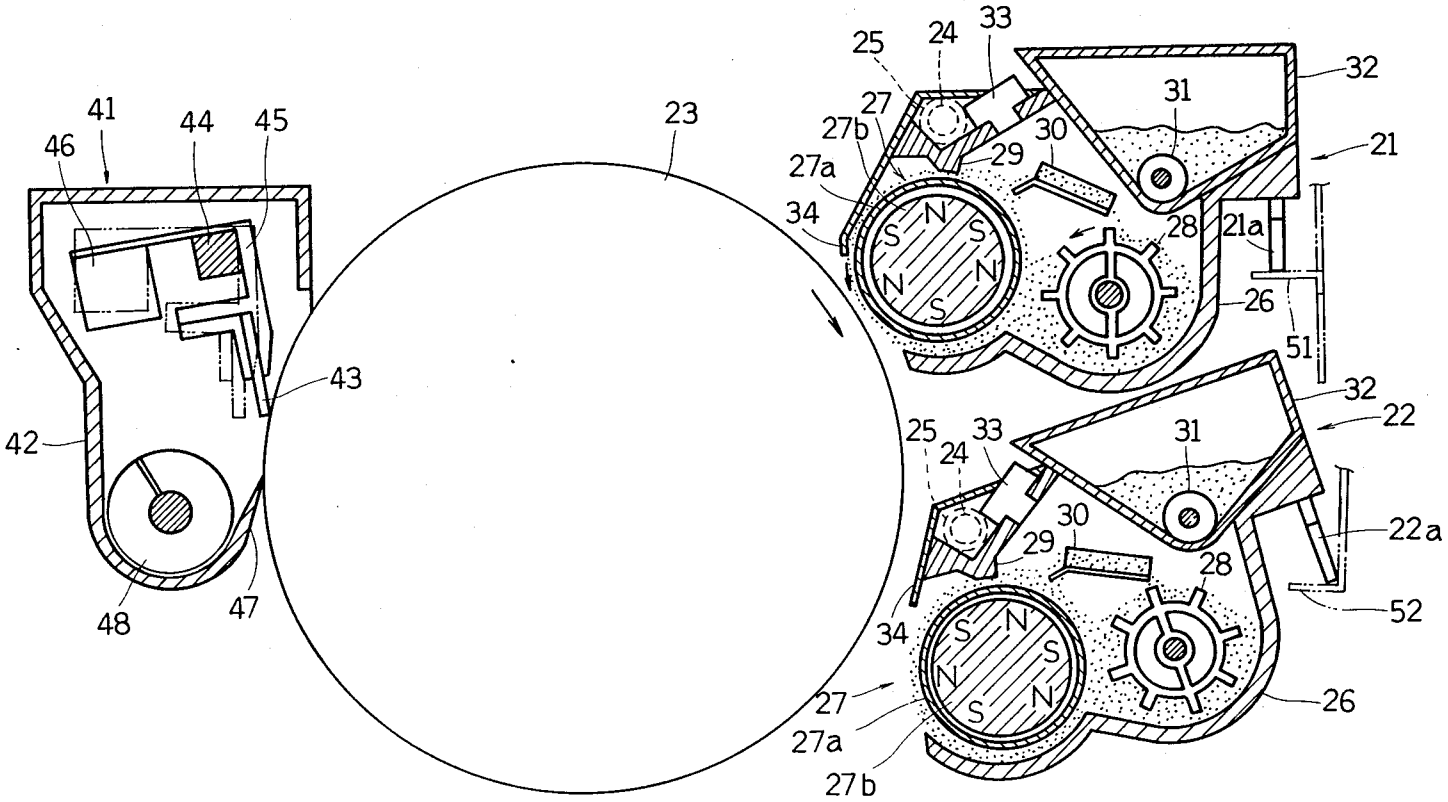
FIG. 6 is a structural diagram in section of the main part of a multicolor image forming apparatus in which the switching control method of this invention is embodied, the upper developing unit being in its developing state.

Referring to FIG. 6, developing units 21, 22 are arranged along the circumference of a photoreceptor drum 23 which is rotationally driven by a drive motor (reference numeral 75 in FIG. 12), as numbered in the order of its turning direction, with the front and rear side bearing parts 25, 25 of the developing units 21, 22 supported by pins 24, 24 provided on front and rear side plates (85, 86 in FIG. 15) inside the apparatus, for each unit to be swingable and by this swinging, it is approached to or distanced from the photoreceptor drum 23; in that way, switching is made mutually oppositely between the developing state and the non-developing state.

A developing roller 27, 27 which serves to develop the latent image on the photoreceptor drum 23 in the developing state of the developing units 21, 22 is provided therein along an opening of its case 26, 26 where it faces the photoreceptor drum 23.

This developing roller 27, 27 is comprised of a cylindrical sleeve **27*a*, 27*a* which is made by nonmagnetic material and driven to rotate, and a magnet roller 27*b*, 27*b* having a plurality of magnetic poles therearound, which is unrotatably housed in this sleeve 27a, 27*a***.

Inside the case 26, 26 of each developing unit 21, 22, respectively different color developers are housed and there are provided a stirring roller 28, 28 for stirring the developer inside the case 26, 26, magnetic brush cutting member 29, 29 which controls the layer thickness of the developer deposited on the surface of the developing roller 27, 27, guide plate 30, 30 for refluxing the developer intercepted by this magnetic brush cutting member 29, 29, supplementing tank 32, 32 equipped with a toner supplementing roller 31, 31 for supplementing developing toner into the case 26, 26 and a sensor 33, 33 for detecting the toner concentration of the developer inside the case 26, 26. Based on the detection signal of this sensor 33, 33, the rotational drive of the aforementioned toner supplementing roller 31, 31 is controlled.

At the lower part of the back side of each case 26, 26, a guide piece **21*a*, 22*a* for making the aforementioned switching is provided and this guide piece 21*a*, 22*a* is mounted on a holder 51, 52** of a switching mechanism which will be explained hereinafter.

Numeral 34, 34 designates an upper cover of the developing unit 21, 22, which serves as a seal member.

On the other hand, on the perimeter of the photoreceptor drum 23 and nearly on the opposite side from the aforementioned developing unit 21, 22, a cleaning unit 41 for removing the developer (toner) left untransferred on the photoreceptor drum 23 after transfer process.

This cleaning unit 41 is equipped inside the cleaning case 42 with a cleaning blade 43 which is acted either to make contact with or to be taken away from the photoreceptor drum 23 in response to the operation state of either forming image or not.

This cleaning blade 43 is held by a rotatable shaft 44 through a holding member 45. This holding member 45 is equipped with a weight 46 for providing the contact pressure onto the photoreceptor drum 23 to obtain the cleaning action. Both end portions of the shaft 44, not shown in this FIG.ure, are formed in a cylindrical shape and supported by bearings, such that by the ON-OFF operation of the blade solenoid (74 in FIG. 12), the blade 43 is switched between its contacted and distanced states, relative to the photoreceptor drum 23, as shown by the real line and the double dotted chain line.

Numeral 47 denotes a seal member for prevention of scattering of the toner which has been scraped off by the blade 43. Numeral 48 stands for a spiral which is rotationally driven for conveying the toner scraped off by the cleaning blade 43 to a collecting case (not shown in the drawings) mounted on one end side of the shaft in its axial direction.

Figure 9:
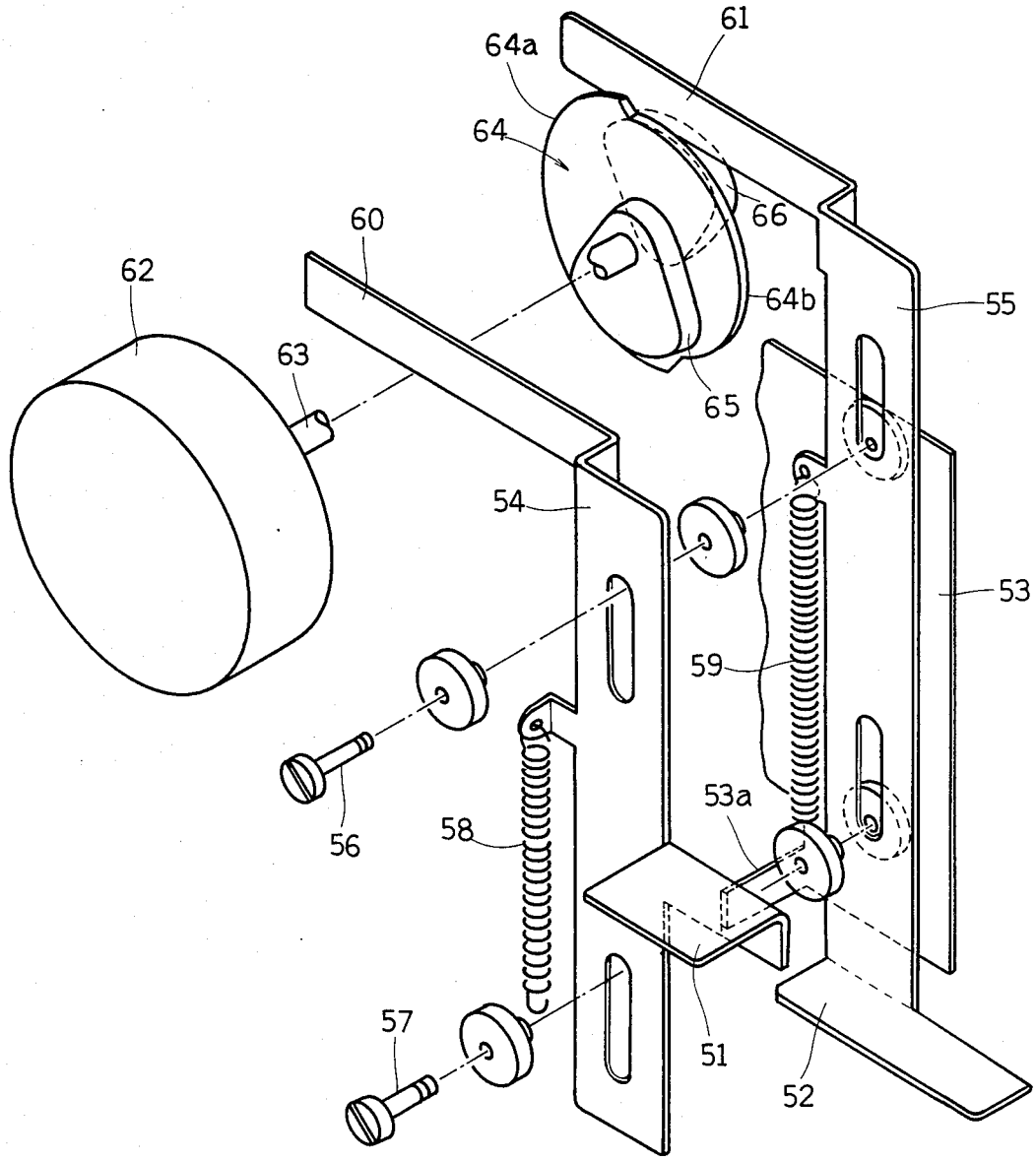
FIG. 9 is a decomposed perspective view illustrating the switching mechanism of the developing unit.

In the following, the switching mechanism of the developing units 21, 22 is described with reference to FIGS. 9 -11.

The holder 51, 52 on which the guide piece **21*a* 22*a* of the aforementioned developing unit 21, 22 is carried is formed integrally with a vertically long slide plate 54, 55 which is vertically movably guided relative to each side plate 53** inside the apparatus.

These slide plates 54, 55 are supported by the side plate 53 by inserting screw shafts 56, 57 in slots oblong in vertical direction and urged downward with springs 58, 59, respectively, stretched between these plates and the arm **53*a* of the side plate 53**.

At the top of the slide plates 54 and 55, there are formed cam followers 60, 61 extending in the horizontal direction and these cam followers 60, 61 are carried on fan shape cams 65, 66 which are mounted on both surfaces of a cam disc 64 with a phase difference of 180°.

The cam disc 64 is coupled with an output shaft 63 of a motor 62 as the drive source for making switching between the developing units 21, 22 and has semicircular cam portions **64*a* and 64*b*** with different radiuses, forming its outer circumferential surface.

Figure 7:
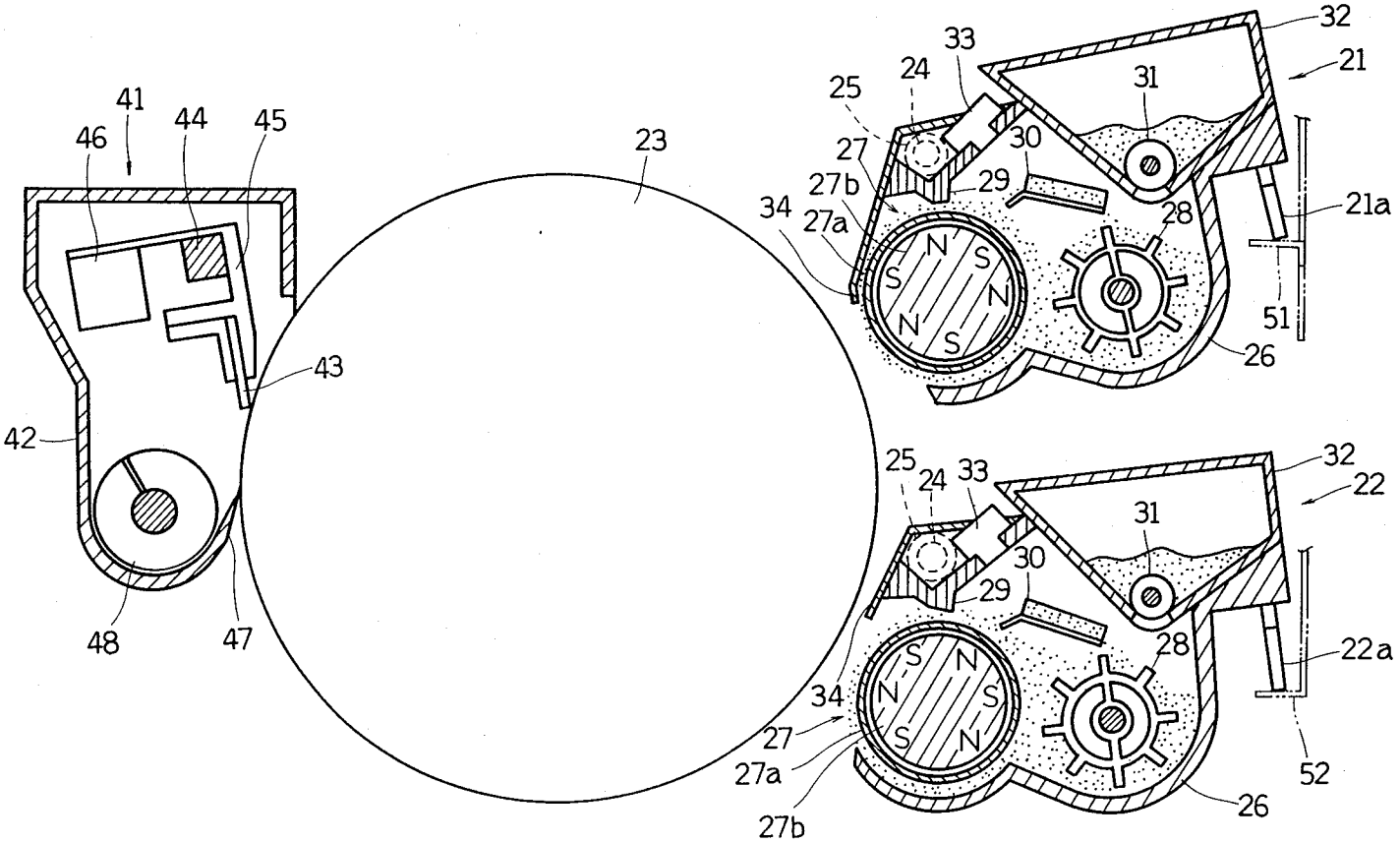
FIG. 7 is a corresponding diagram to that of FIG. 6 in which the upper and the lower developing units both are in their intermediary state.

As shown in FIG. 7, there is provided a switch (developing unit switch 76) which operates in rubbing contact with the semicircular cam portion **64*a*, 64*b*; by this switch 67, half turn of the cam disc 64 is detected and the drive of the motor 62** is stopped upon its turning of a specified angle, as described later.

The aforementioned developing unit switching motor 62 is rotationally driven by making on a switch for selecting either one of the developing units 21, 22 at an operation unit (72 in FIG. 12) of the apparatus.

Figure 10:
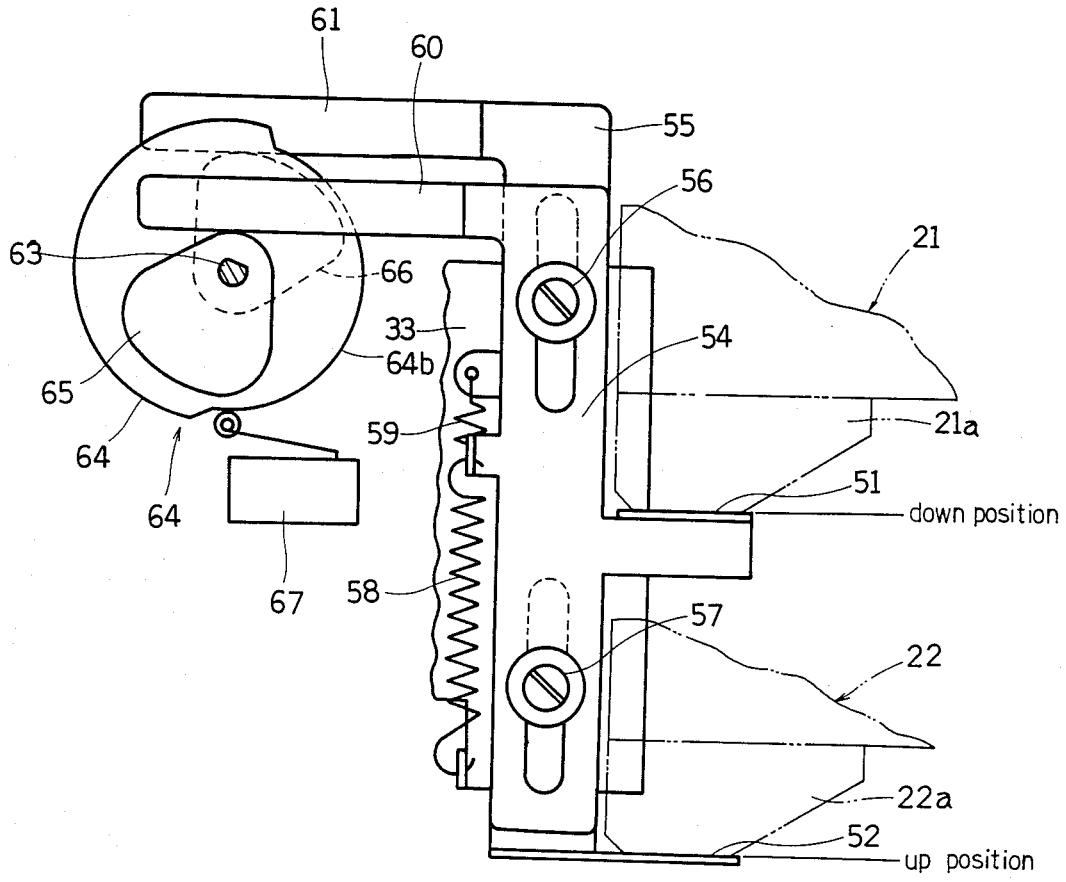
FIGS. 10 and 11 are side views for explanation of the operation of the mechanism shown in FIG. 9.

As shown in FIG. 10, when the cam follower 60 is supported by the small diameter portion of the fan shape cam 65 and urged downward by the force of the spring 58, while the cam follower 61 is raised by the large diameter portion of the fan shape cam 66 against the urging force of the spring 59, the slide plate 54 and the holder 51 are brought to their down position, while the slide plate 55 and the holder 52 are in their up position. Accordingly, the developing unit 21 is swung around the supporting pin 24 as its pivot in the direction of approaching the photoreceptive drum 23, to be in its developing state. And the developing unit 22 is swung around the supporting pin 24 as its pivot in the direction of distancing from the photoreceptor drum 23, to be in its non-developing state. FIG. 6 represents this state.

Figure 8:
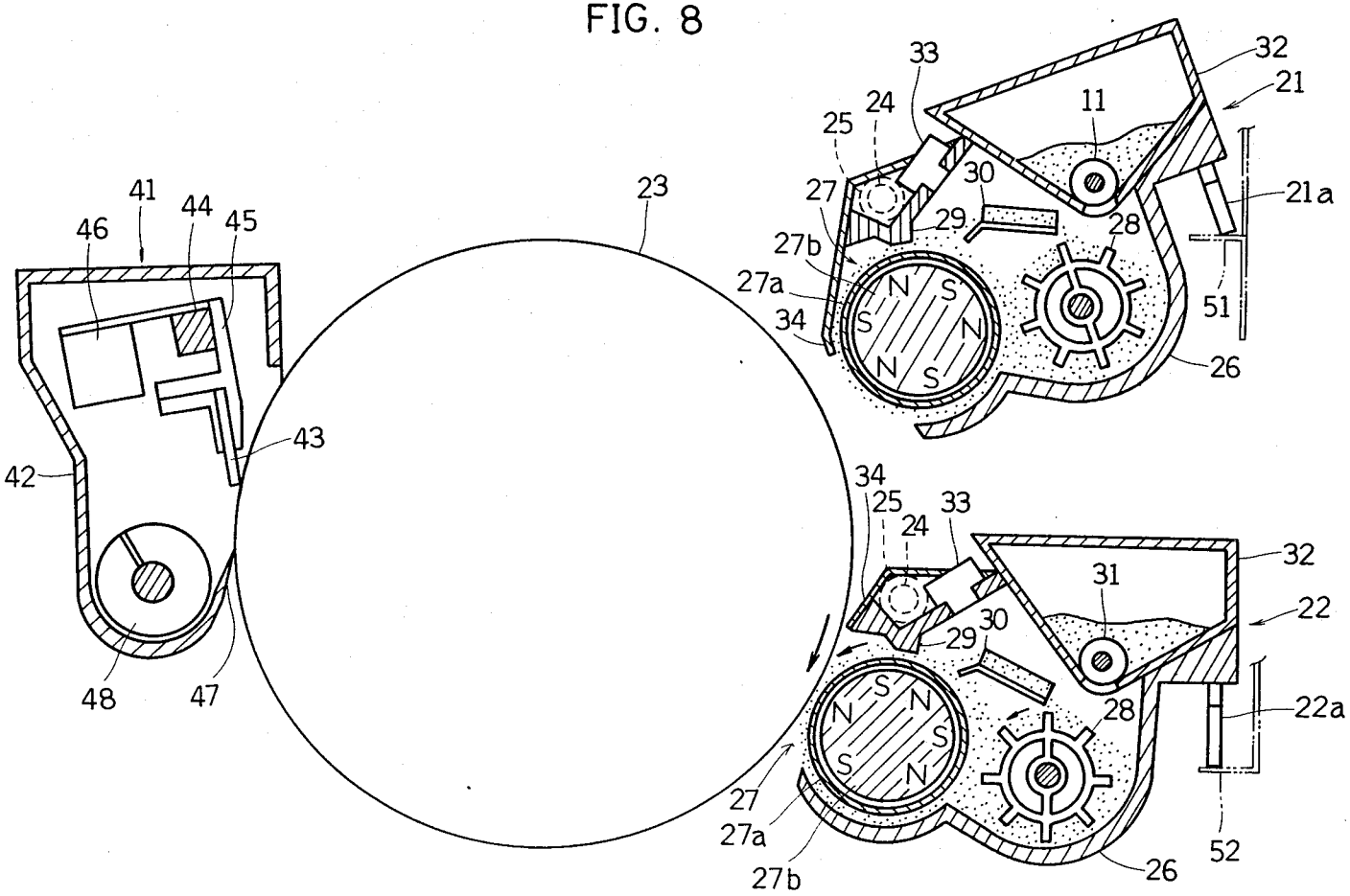
FIG. 8 is a corresponding diagram to that of FIG. 6 in which the lower developing unit is in its developing state.
Figure 11:
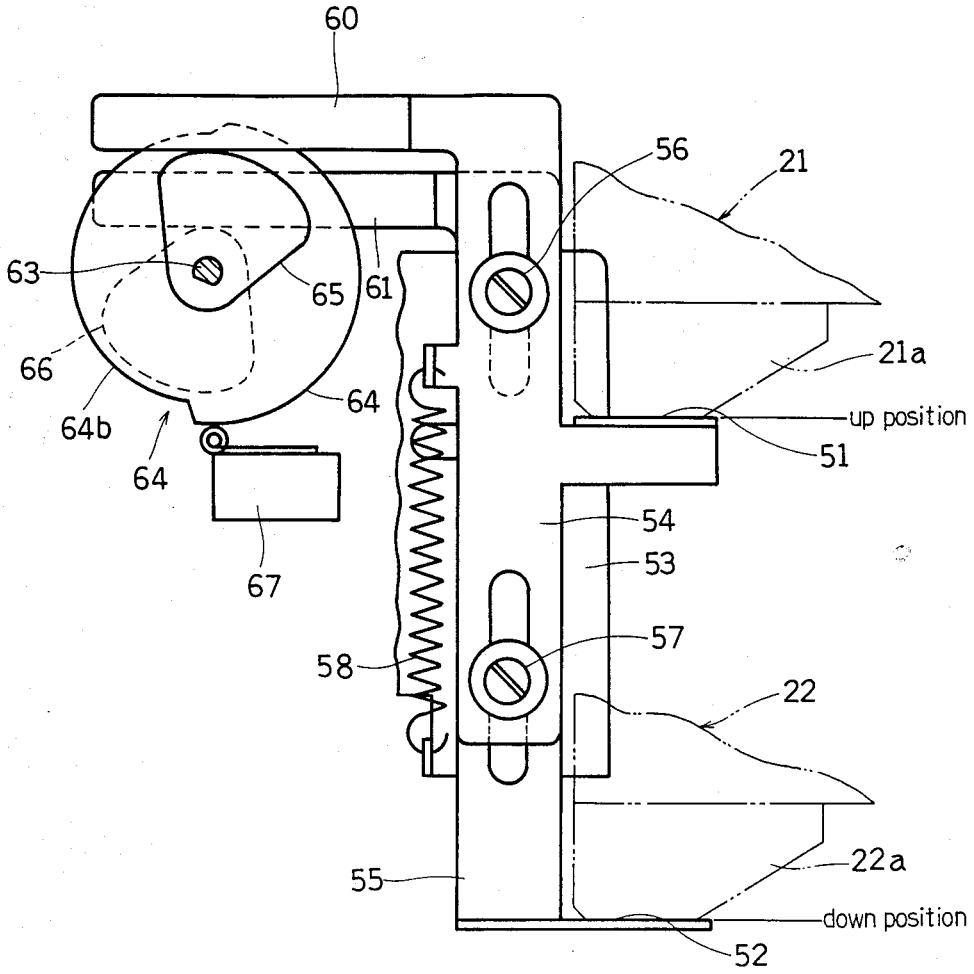

On the other hand, as shown in FIG. 11, when the cam follower 60 is raised by the large diameter portion of the fan shape cam 65 against the urging force of the spring 58, the slide plate 54 and the holder 51 are brought to their up position; accordingly, the developing unit 21 is swung around the supporting pin 24 as its pivot in its distancing direction from the photoreceptor drum 23, thereby to be switched into its non-developing state. At this time, the other developing unit 22, with its holder 52 brought to its down position, is switched into its developing state in which it is approached to the photoreceptor drum 23. FIG. 8 represents this state.

In the intermediate region where the intermediate portion between the large diameter portion and the small diameter portion of the fan shape cam 65, 66 is corresponded to each cam follower 60, 61, each developing unit 21, 22 is in its intermediary state between its developing state and its non-developing state. This state is temporarily passed, when the developing units is transferred from the state represented by FIG. 6 to that of FIG. 8 or when transferred from the state of FIG. 8 to that of FIG. 6.

This invention provides a timing control for switching between developing units in order to prevent the previously used toner which has left on the photoreceptor drum 23 from being conveyed, as the photoreceptor drum 23 rotates, to be mixed into another different developing unit. Thus the switching timing is so set that the cleaning blade 43 is brought into contact with the photoreceptor drum 23, the photoreceptor drum 23 is turned and after the end edge of the spot on the photoreceptor drum 23 with which the cleaning blade 43 came in contact, as it was switched from OFF to ON, has passed the developing region assigned to the newly selected developing unit, the newly selected developing unit will be brought into its developing state.

Figure 12:
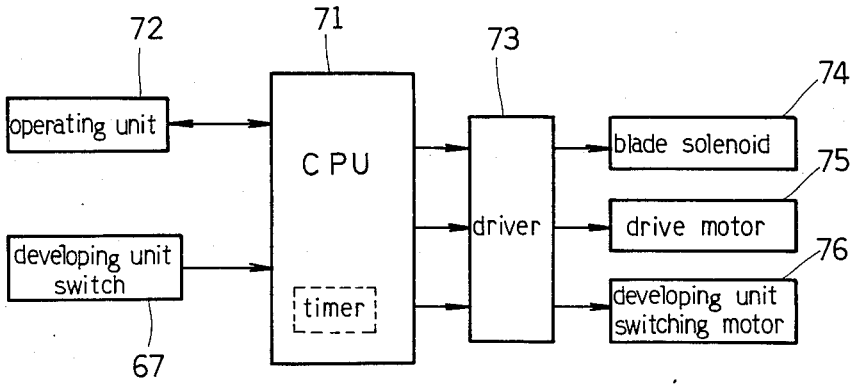
FIG. 12 is a block diagram of the main part of a construction for embodying the control method of this invention.

The construction of the control system for embodying this control method is shown in FIG. 12. And the operation flow charts are given in FIGS. 13 and 14.

Referring to FIG. 12, a central processing unit (CPU) 71 makes drive control of such actuators as blade solenoid 74, drive motor 75 for driving the photoreceptor drum 23 and developing unit switching motor 62, etc., through a driver 73, based on the input from the operating unit 72 and the aforementioned developing unit switch 67. Besides, it has the function of a timer.

Figure 13:
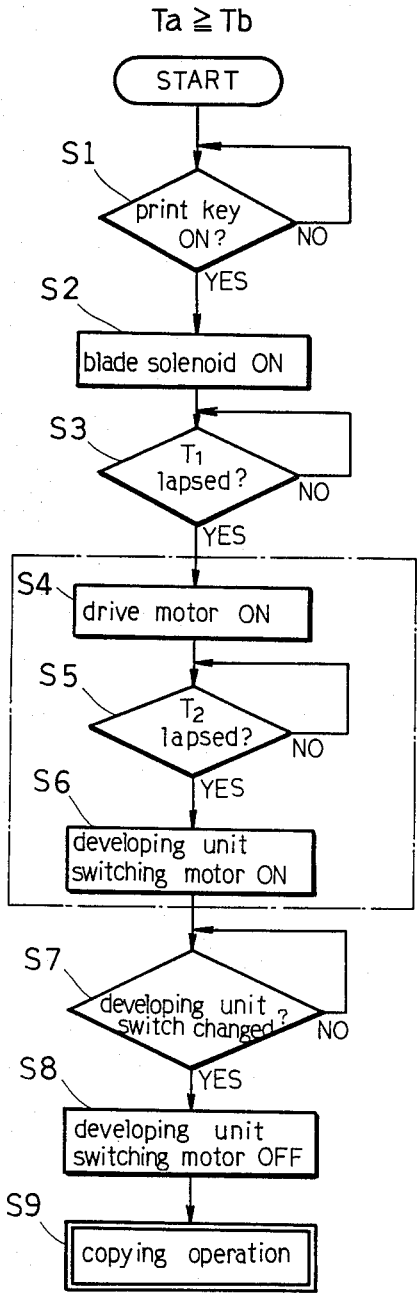
FIGS. 13 and 14 are flow charts for explanation of this method.
Figure 14:
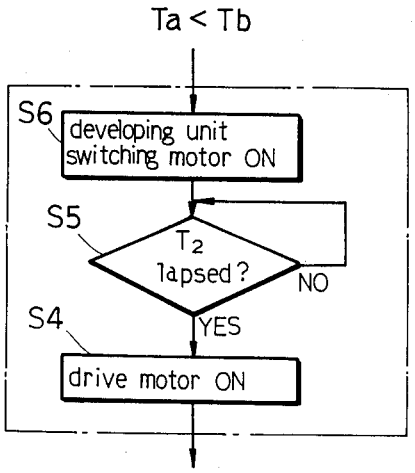

And an instruction input for selecting the developing unit in order to specify the developing color by the operating unit 72, and the image forming operation instruction, thus, the print key, is made ON, whereby CPU 71 controls a variety of actuators, following the steps as shown in FIG. 13 or 14.

Whether the steps shown in FIG. 13 or the steps shown in FIG. 14 is applied will be determined by the following conditions:

Now, the time required for the toner at the spot on the photoreceptor drum 23 with which the blade 43 was in contact to reach the developing region of the newly selected developing unit, as the drum 23 turns, is represented by Ta. This time Ta, which differs depending on which developing unit 21 or 22 is newly selected, will be unitarily determined, as one is selected. Then the time taken for transfer from the state of FIG. 6 to that of FIG. 7 or from the state of FIG. 8 to that of FIG. 7 is represented by Tb. This time Tb is the time taken for the newly selected developing unit to be brought into its intermediary state before becoming its developing state from its non-developing state and is given by $Tb = Tc/4$, if the time required for 1 cycle switching of the developing unit 1 or 2, as it goes from its developing state through its non-developing state and again to its developing state, is represented by Tc. And depending on the relationship between the times Ta and Tb, or whether $Ta \geqq Tb$ or $Ta < Tb$, the steps of the flow chart should be partly differentiated. FIG. 13 represents the steps to be taken when $Ta \geqq Tb$, while FIG. 14 provides for the steps to be taken when $Ta < Tb$, showing that only the part circumscribed by a dotted chain line in FIG. 13 is to be changed.

The aforementioned condition, in other words, implies whether, when the developing unit switching motor 62 and the drive motor 75 are simultaneously made ON, the toner on the spot of the photoreceptor drum 23 with which the blade 43 came in contact will pass through the position of the newly selected developing unit or not, before the newly selected developing unit has been brought to its intermediary state.

In the following, the control steps are described with reference to the flow charts: When $Ta \geqq Tb$, as shown in FIG. 13, at step $S_1$ whether the print key has been made ON is checked; if it is ON, the blade solenoid 74 is made ON at step $S_2$ and then, after a lapse of the specified delay $T_1$ by step $S_3$, the drive motor 75 is made ON at step $S_4$. Then with the absolute value of the difference between the times Ta and Tb represented as $T_2$ whether the time $T_2$ has elapsed or not is checked at step $S_5$ and upon the lapse of this time $T_2$ the developing unit switching motor 62 is made ON at $S_6$. Subsequently at step $S_7$ whether the developing unit switch 67 has been changed over or not is checked. As the cam disc 64 makes a half turn, this switch 67 is changed over, to make the developing unit switching motor 62 OFF. Then the copying operation of step $S_9$ is entered.

On the other hand, when $Ta < Tb$, as shown in FIG. 14, the aforementioned step $S_4$ and step $S_6$ are exchanged in sequence. Thus if the developing unit switching operation rate is relatively slower than the rate of revolution of the photoreceptor drum 23, the ON making of the developing unit switching motor 62 should precede the ON making of the drive motor 75.

The times Ta and Tb may be altered, depending on the rate of revolution of the photoreceptor drum 23, rate of switching between the developing units 1, 2, the position of the developing units 1, 2 and so on. Therefore, by appropriately selecting these parameters and providing the switching control as hereabove described, it is possible to bring the developing unit 21 or 22 into the state of being midway of switching between the non-developing and the developing states, or both of the developing units 21, 22 into their retreated state, that is, the state shown in FIG. 7, when the toner at the spot on the photoreceptor drum 23 with which the blade 43 came in contact has been conveyed by the turning of the photoreceptor drum 23 to come into the developing region of the developing unit 21 or 22; for this reason the aforementioned toner makes free pass through the positions facing the developing units 21, 22. Accordingly, such a trouble as unexpected color mixing caused by the toner of the previously used color mixed with the magnetic brush of the different color developer of the developing unit selected this time is averted.

Moreover in an apparatus in which a plurality of developing units are oppositely switched as in the above-described embodiment, the effect of suppressing toner scattering resulting from the sticking toner on the seal member 34, 34 may be added by letting the toner at a spot on the photoreceptor drum 23 with which the blade 43 came in contact pass the developing regions of both developing units in the state of being retreated from the photoreceptor drum 23.

It should be understood that the control method comprising the aforementioned steps is applicable when switching between developing units is made, but when the developing unit is not changed from the previously used one, the aforementioned steps need not be taken, because there is no fear of color mixing.

Similar switching control may be applicable not only to apparatus in which the switching between developing units is made oppositely as hereabove-described, but to those in which the switching drive is made individually; furthermore, this method is likewise applicable to those which move in straight line or those equipped with 3 or more developing units, besides those in which the state is altered by swinging (rotation) of the developing unit.

In the aforementioned embodiment, if the apparatus is equipped with the so-called auto-clear system which makes automatic return to the standard mode color developing unit, after accomplishing a copying operation, it is proper to perform the switching operation comprising the aforementioned steps after a lapse of a specified time after accomplishing the copying operation. Accordingly, with an apparatus which gives $Ta \geqq Tb$, for example, it is proper to make rotational drive of the photoreceptor drum 23 with the drive motor 75 made ON, while the blade 43 is in the state of being ON after a lapse of a specified time after accomplishing the copying operation, to make the developing unit switching motor 62 ON upon a lapse of the aforementioned time $T_2$ and to make this motor 62 OFF when the developing unit switch 65 has been switched.

Thus according to the invention a developing unit switching control method in a multicolor image forming apparatus having arranged on the perimeter of a photoreceptor a plurality of developing units for developing latent image on the photoreceptor and a cleaning unit equipped with a cleaning blade for removing residual developer left on the photoreceptor after making a transfer, which effects switching between the developing state and the non-developing state of each developing unit by approaching the newly selected developing unit to and distancing the others from the photoreceptor and which brings the cleaning blade in contact with the photoreceptor or which takes it away therefrom in response to the state either the image forming operation state or non-image forming state; based on the developing unit selection change instruction and the image forming instruction, the cleaning blade is approached to the photoreceptor, the photoreceptor is driven, and after the end edge portion of the spot on the photoreceptor with which the aforementioned cleaning blade came in contact has passed the developing region of the newly selected developing unit, the newly selected developing unit is approached to the photoreceptor, to bring it into its developing state: is provided and consequently, for example, even if the developer (toner) accumulated on the cleaning blade has come to the developing unit side, riding on the photoreceptor, since the developing unit is in the state of being retreated from the photoreceptor, the toner will have a free pass; as a result, the possibility of the aforementioned toner mixing with the magnetic brush of the developer of the developing unit will be foreclosed.

When the developing unit used is a magnetic brush developing unit, because an ear of developer as described hereunder occurs as the developing unit has been switched from its developing state to its non-developing state, such a problem as color mixing, etc., is liable to be raised unless the developing unit is widely retreated from the photoreceptor in its non-developing state.

Figure 17:
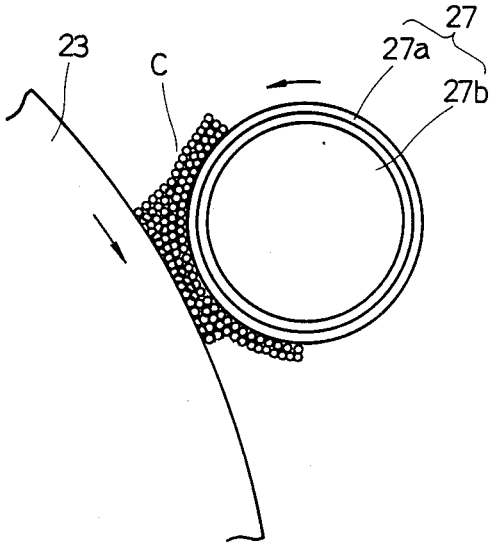
FIG. 17 is a diagram for explanation of the action of this apparatus in its developing state.
Figure 18:
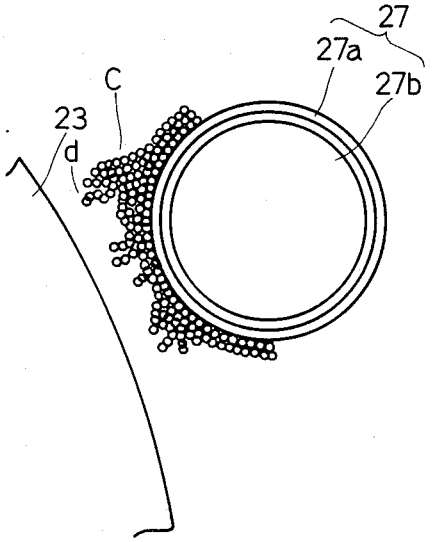
FIG. 18 is a diagram for explanation of the action of this apparatus immediately after it has been switched from its developing state into its non developing state.

Thus as explaining this phenomenon, with reference to FIGS. 17 and 18, under the developing state, as shown in FIG. 17, a developer accumulation C is produced on the up-stream side relative to the turning direction, in the space between the photoreceptor drum 23 and a sleeve 27*a* facing it and rotationally driven in the normal direction. And when making a switching from this state to the nondeveloping state, for prevention of scattering of the developer, the rotation of the sleeve 27*a* is stopped under the state of FIG. 17 and, then, as shown in FIG. 18, the developing roller 27 is moved away (retreated) from the photoreceptor drum 23. However, even at the time after the switching, as shown in FIG. 18, a swollen developer accumulation C similar as abovementioned is left. Moreover, in addition to the developer accumulation C, coarse ear d occurs due to 15 the residual charge (about 30–100 V), as shown in FIG. 18, when the developing roller 27 has come apart from the photoreceptor drum 23. From this coarse ear d, the developer or toner tends to sputter toward the photoreceptor drum 23, causing unexpected color mixing. Accordingly, for prevention of such a color mixing, the developing unit needs to be widely retreated from the photoreceptor drum 23 under its non-developing state. However, as a result, extra space will be required on the perimeter of the developing unit, thus tending to thwart miniaturization of the multicolor image forming apparatus itself.

Then by adopting a construction as described hereunder, it is possible to recover the normal state of the developing unit having no coarse ear d from developer accumulation C, thereby preventing scattering of developer of toner at the retreating time of the developing unit, fore-stalling unexpected color mixing and, moreover, effecting space saving, without having to provide wide retreating space.

Figure 15:
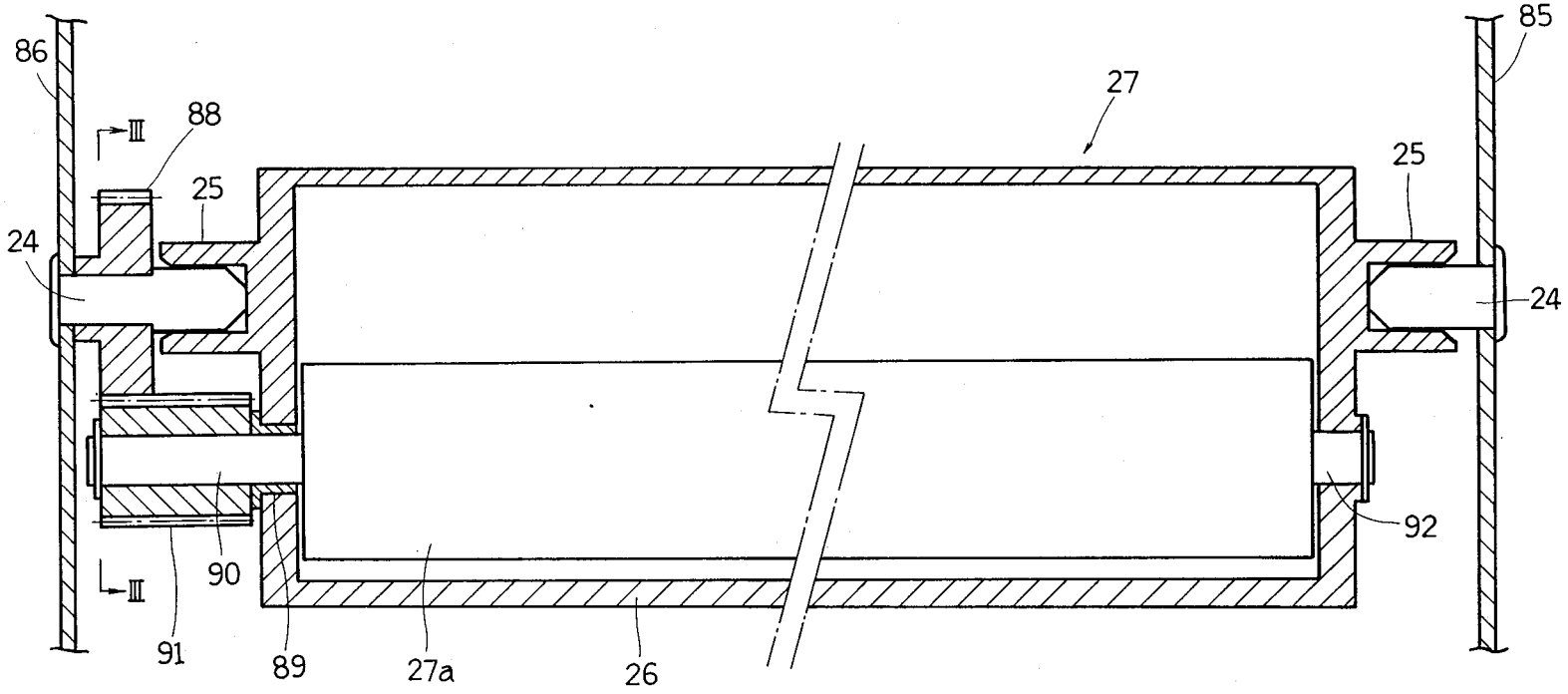
FIG. 15 is a longitudinal sectional view of the main part of a multicolor image forming apparatus shown in FIG. 6.
Figure 16:
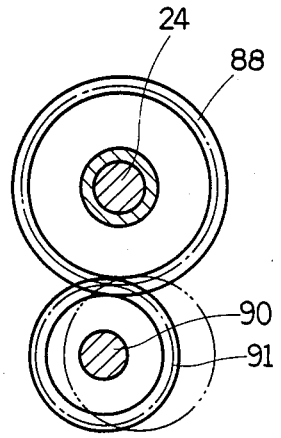
FIG. 16 is a sectional view taken along the line III—III of the FIG. 15.

In the developing roller 27, the sleeve 27*a* is rotationally driven under the developing state, but under the non-developing state, its rotational driving is suspended for prevention of scattering of developer. As a structure for transmission of the driving force, as shown in FIGS. 15 and 16, a driving gear 88 is rotatably mounted on a supporting pin 24, while on the shaft 90 of the sleeve 27 supported by a bearing 89 of the case 26, a driven gear 91 is fixedly fitted; these two gears 88, 91 are meshed and to the driving gear 88, driving force is supplied from a drive source, not shown in this Figure, through a spring clutch or an electromagnetic clutch or so on. With the drive structure as hereabove-described, even if the developing units 21, 22 change in their posture by making swing between their developing and non-developing states, the meshing between the aforementioned two gears 88, 91 will not be undone, as shown by the state after displacement which s represented by a double dotted chain line in FIG. 16.

The magnet roller 27*b* (see FIG. 6) has its one end supported by a shaft 92 one end of which is fixed on the case 26, while the other end (not shown in the drawings) is supported by the interior of the sleeve 27*a* through a bearing (not shown in the drawings). On the other hand, the end portion on the side opposite to the side where the gear 91 of the sleeve 27*a* is provided is supported by the periphery of the magnet roller 27*b* through a bearing (not shown in the drawings).

The action of developing the latent image on the photoreceptor drum 23 by means of the developing roller 27 is exerted, as well known, by conveying the developer supplied onto the developing roller 27 or the sleeve 27*a* to the developing part facing the photoreceptor drum 23 by way of rotation of the sleeve 27i a, bringing the state of the so-called magnetic brush by the action of the magnet roll 27*b* and making rubbing contact of this magnetic brush with the photoreceptor drum 23.

And as hereabove-described, the rotational drive of the sleeve 27*a*, 27*a* is suspended, when making switching from the developing state to the non-developing state of the developing unit 21, 22, but at this switching time, the sleeve 27*a*, 27*a* is turned over a small amount by making use of the aforementioned driving structure. This small amount should be on the order of from $\frac{1}{3}$ turn to 1 turn, for too large a turning amount will lead to scattering of developer. The timing for making the turning should most preferably be after the time when the switching has been accomplished, from the stand point of prevention of scattering of developer. But it is permissible that the starting point of the turning operation occurs while the switching transfer is going on.

Figure 19:
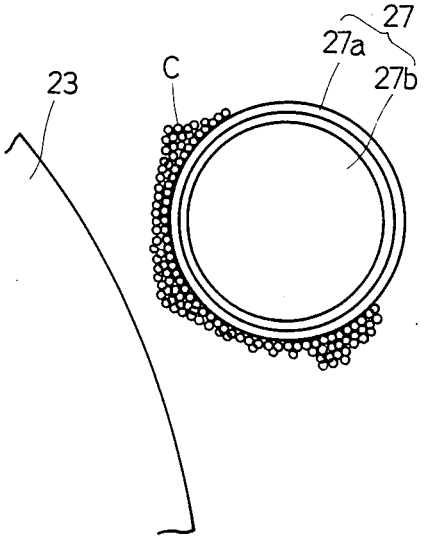
FIG. 19 is a diagram for explanation of the action of this apparatus in its non-developing state.

By this small amount of turning, the coarse ear d which occurs when the developing unit was retreated as shown in FIG. 18 will be removed as shown in FIG. 19. With the coarse ear of developer removed in this way, color mixing can be averted without having to retreat the developing unit 21, 22 too widely from the photoreceptor drum 23 at the time of non-developing state and the toner scattering due to the wind induced by the cooling air for prevention of temperature rise in the apparatus becomes hardly taking place.

In the foregoing, an apparatus in which the sleeve 27*a* is rotationally driven, but the magnet roller 27*b* is not turned in its developing state is shown, but conversely, in an apparatus in which the inside magnet roller is rotationally driven, while the sleeve is stationarily held, the coarse ear d may similarly be removed by turning the magnet roller by a small amount at the switching time to the nondeveloping state.

The above-described operation may be achieved merely by a little altering the control procedure with a driving means comprising a developing sleeve 27*a*, etc.

Thus it is proper to turn the sleeve of the developing roller or the magnet roll by substantially a small amount, to ensure that the coarse ear of developer be aligned and stabilized. This method is readily applicable also to the copier shown in FIG. 1. This method is likewise applicable not only to those devices in which the developing units 2, 3 take their two postures—developing state and nondeveloping state—but also to those which have intermediary state between them or those equipped with 3 or more developing units.

While only certain embodiments of the present invention have been described, it will be apparent to those skilled in the art that various changes and modifications may be made therein without departing from the spirit and scope the present invention as claimed.

What is claimed is:

1. A color image forming apparatus having a plurality of developing units each containing different color toner, which can change a color of an image by alternative selection effected by bringing a newly selected developing unit close to a photoreceptor drum and moving 2 former one away therefrom, the apparatus comprising a sequence control means for rotating the photoreceptor drum by a specified amount or angle, while the former developing unit is in the state of being close to the photoreceptor drum, after making an image with the former color, but before copying an image with the newly selected color and, thereafter, alternatively selecting the newly selected developing unit.

2. The apparatus according to claim 1 wherein the former color toner is black toner and the newly color toner is a color toner other than black one.

3. The apparatus according to claim 1 or 2 wherein the specified amount is greater than the amount of rotation from a position on the photoreceptor drum directly facing the cleaning blade to a position directly facing the developing unit which is the newly selected one or former one and located on the upstream side thereof, as defined by the rotation of the photoreceptor drum.

4. The apparatus according to claim 1 wherein each of the developing units is a magnetic brush developing unit having a rotatable developing roller which rotates in its developing state, but stops in its non-developing state and a rotation control means which makes a sleeve or magnet roller of the rotatable developing roller turn slightly at the switching time from the developing state to the non-developing state.

5. The apparatus according to claim 1 or 2 wherein the specified amount is greater than the amount of rotation from a position on the photoreceptor drum directly facing the cleaning blade to a position directly facing the newly selected developing unit, as defined by the rotation of the photoreceptor drum.

6. The apparatus according to claim 1 or 2 wherein the specified amount is greater than the amount of rotation from a position on the photoreceptor drum directly facing the cleaning blade to a position directly facing the former developing unit placed downstream side thereof, as defined by the rotation of the photoreceptor drum.

7. A developing unit switching control method in a multicolor image forming apparatus having arranged on the perimeter of a photoreceptor a plurality of developing units for developing latent image on the photoreceptor and a cleaning unit equipped with a cleaning blade for removing residual developer left on the photoreceptor after making a transfer, which effects switching between the developing state and the non-developing state of each developing unit by bringing the newly selected developing unit close to and the others away from photoreceptor and which brings the cleaning blade in contact with the photoreceptor or which takes it away therefrom in response to the state either the image forming operation state or non-image forming state; based on the developing unit selection change instruction and the image forming instruction, the cleaning blade is brought to the photoreceptor, the photoreceptor is driven, and after the end edge portion of the spot on the photoreceptor with which the aforementioned cleaning blade came in contact has passed the developing region of the newly selected developing unit, the newly selected developing unit is brought close to the photoreceptor, to bring it into its developing state.

8. The method of claim 7 wherein each of the in its developing state, its sleeve or magnet roller is rotationally driven, but in its non-developing state, its rotational drive is suspended and at the time of making a switching from the developing to non-developing state, the rotatable developing roller is turned slightly.

9. The method according to claim 7 wherein while the end edge portion of the spot on the photoreceptor with which the cleaning blade came in contact is passing the developing region of the newly selected developing unit, the newly selected developing unit is in an intermediate state between its non developing state and its developing state.

* * * * *

UNITED STATES PATENT AND TRADEMARK OFFICE

CERTIFICATE OF CORRECTION

PATENT NO. : 4,860,053

DATED : Aug 22, 1989

INVENTOR(S) : Haruo Yamamoto, et al

It is certified that error appears in the above-identified patent and that said Letters Patent is hereby corrected as shown below: COLUMN 14;

Claim 1, Line 6: Change "2" to --a--,

Claim 2, Line 2: Enter --selected-- after "newly",

COLUMN 16:

Claim 8, Line 1: Change "of" (first occurrence) to --according to--, and between "the" and "in" enter --developing units is a magnetic brush developing unit;--, Line 2: Change "sleeve or magnet" to --rotatable developing--, Line 5: between "to" and "non-developing" enter --the--,

Signed and Sealed this

Fourth Day of August, 1992

*Attest:*

DOUGLAS B. COMER

*Attesting Officer*

*Acting Commissioner of Patents and Trademarks*